US009069295B2

(12) United States Patent
Igarashi et al.

(10) Patent No.: US 9,069,295 B2
(45) Date of Patent: Jun. 30, 2015

(54) CLEANING UNIT, AND IMAGE FORMING APPARATUS

(71) Applicant: FUJI XEROX CO., LTD., Tokyo (JP)

(72) Inventors: Tatsuhiro Igarashi, Kanagawa (JP); Manabu Furuki, Kanagawa (JP); Masashi Ikeda, Kanagawa (JP); Teppei Yawada, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/257,336

(22) Filed: Apr. 21, 2014

(65) Prior Publication Data

US 2015/0104231 A1 Apr. 16, 2015

(30) Foreign Application Priority Data

Oct. 15, 2013 (JP) ..... 2013-214383

(51) Int. Cl.
*G03G 21/00* (2006.01)
*G03G 15/16* (2006.01)

(52) U.S. Cl.
CPC ..... *G03G 15/168* (2013.01)

(58) Field of Classification Search
CPC ..... G03G 15/168
USPC ..... 399/346, 350, 358
See application file for complete search history.

(56) References Cited

U.S. PATENT DOCUMENTS

| | | | | |
|---|---|---|---|---|
| 5,349,429 | A * | 9/1994 | Jugle et al. | 399/346 |
| 7,043,188 | B2 * | 5/2006 | Curynski et al. | 399/346 |
| 8,301,070 | B2 * | 10/2012 | Matsumoto | 399/346 |
| 2009/0324279 | A1 | 12/2009 | Miyahara et al. | |

FOREIGN PATENT DOCUMENTS

| | | |
|---|---|---|
| JP | A-09-090837 | 4/1997 |
| JP | A-2009-053416 | 3/2009 |
| JP | A-2010-008652 | 1/2010 |

* cited by examiner

*Primary Examiner* — William J Royer
(74) *Attorney, Agent, or Firm* — Oliff PLC

(57) ABSTRACT

Provided is a cleaning unit including a removing member that contacts with a surface of a cleaning target and removes adherent matters on the surface of the cleaning target, a storage section that stores the adherent matters removed by the removing member, and a supply member that has a blade and rotates the blade in the storage section to supply some of the adherent matters stored in the storage section to the surface of the cleaning target.

10 Claims, 5 Drawing Sheets

CLEANING UNIT, AND IMAGE FORMING APPARATUS

CROSS-REFERENCE TO RELATED APPLICATIONS

This application is based on and claims priority under 35 USC 119 from Japanese Patent Application No. 2013-214383 filed Oct. 15, 2013.

BACKGROUND (i) Technical Field

The present invention relates to a cleaning unit, and an image forming apparatus.

(ii) Related Art

In the related art, there have been known image forming apparatuses that form a toner image and cleaning units that clean transfer residual toner.

SUMMARY

According to an aspect of the invention, there is provided a cleaning unit including:

a removing member that contacts with a surface of a cleaning target and removes adherent matters on the surface of the cleaning target;

a storage section that stores the adherent matters removed by the removing member; and a supply member that has a blade and rotates the blade in the storage section to supply some of the adherent matters stored in the storage section to the surface of the cleaning target.

BRIEF DESCRIPTION OF THE DRAWINGS

Exemplary embodiments of the present invention will be described in detail based on the following figures, wherein.

DETAILED DESCRIPTION

Specific exemplary embodiments of a cleaning unit and an image forming apparatus of the present invention will be described with reference to the following drawings.

Figure 1:
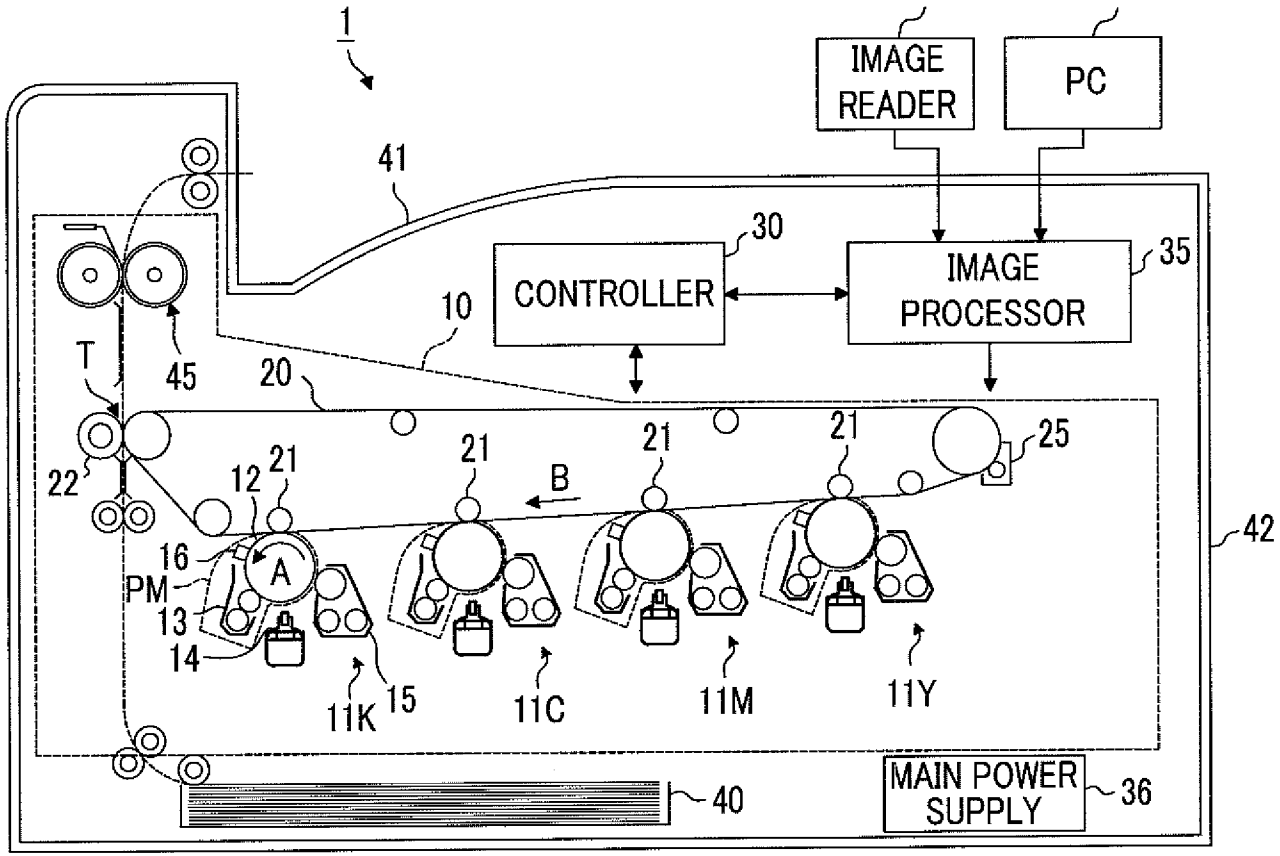
FIG. 1 is a schematic configuration view illustrating a printer corresponding to a first exemplary embodiment of an image forming apparatus.

FIG. 1 is a schematic configuration view illustrating a printer corresponding to a first exemplary embodiment of the image forming apparatus.

A printer 1 shown in FIG. 1 is a so-called tandem type color printer and includes an image formation processing section 10 which performs image formation in correspondence with each color image data, a controller 30 which controls overall operations of the printer 1, an image processor 35 which is connected to external apparatuses, for example, a personal computer (PC) 3 or an image reader 4 and performs image processing on image data received from the external apparatus, and a main power supply 36 which supplies electric power to the respective sections.

The image formation processing section 10 includes four image forming units 11Y, 11M, 11C and 11K (hereinafter, collectively referred to as an "image forming unit 11") arranged in parallel at constant intervals. Each of the image forming units 11 includes a photoreceptor drum 12 on which an electrostatic latent image or a toner image is formed on the surface, a charging unit 13 (within PM) which charges the surface of the photoreceptor drum 12, an LED print head (LPH) 14 which exposes the surface of the photoreceptor drum 12 based on image data, a developing unit 15 which develops the electrostatic latent image formed on the photoreceptor drum 12, and a cleaner 16 which cleans the surface of the photoreceptor drum 12 after transfer.

The photoreceptor drum 12 corresponds to an example of an image holding member in the present invention, and the combination of the charging unit 13, the LPH 14, and the developing unit 15 corresponds to an example of an image forming device in the present invention.

Each of the image forming units 11 has the same configuration except for toner accommodated in the developing unit 15. Each of the image forming units 11 forms a yellow (Y) toner image, a magenta (M) toner image, a cyan (c) toner image, and a black (K) toner image, respectively.

Additionally, the image formation processing section 10 includes an intermediate image transfer belt 20 onto which respective toner images formed by the photoreceptor drums 12 of each of the image forming units 11 is multiply-transferred, a primary transfer roll 21 which sequentially transfers respective toner images formed by each of the image forming units 11 onto the intermediate image transfer belt 20, a secondary transfer roll 22 which collectively transfers superimposed toner images, which are transferred onto the intermediate image transfer belt 20, to a sheet as a recording material, and a fixing unit 45 which fixes the secondary-transferred image onto the sheet.

In the printer 1, the image formation processing section 10 performs an image forming operation according to various control signals supplied from the controller 30. That is, the image processor 35 performs image processing on image data input from the PC 3 and the image reader 4 under the control of the controller 30. The processed image data is supplied to each of the image forming units 11 through an interface (not shown). Then, for example, in the image forming unit 11K of black (K), the photoreceptor drum 12 is charged at a predetermined potential level by the charging unit 13 while rotating in the direction of an arrow A. The LPH 14 used to emit light based on data indicating a black component image of the image data transmitted from the image processor 35 exposes the photoreceptor drum 12. Consequently, an electrostatic latent image corresponding to a black (K) image is formed on the photoreceptor drum 12. Then, the electrostatic latent image formed on the photoreceptor drum 12 is developed by the developing unit 15 and thus, a black (K) toner image is formed on the photoreceptor drum 12. Similarly, a yellow (Y) toner image, a magenta (M) toner image, and a cyan (C) toner image are formed in the image forming units 11Y, 11M, and 11C, respectively.

The respective color toner images formed in each of the image forming units 11 are sequentially and electrostatically attracted on the intermediate image transfer belt 20, which moves in the direction of an arrow B, by the primary transfer rolls 21 to thereby form a full-color toner image on which the respective color toner images are superposed. Residual toner remaining on the photoreceptor drums 12 even after the transfer by the primary transfer rolls 21 is removed from the photoreceptor drums 12 by the cleaner 16 of each of the image forming units 11.

The primary transfer roll 21 corresponds to an example of a transfer unit in the present invention and here, the intermediate image transfer belt 20 corresponds to an example of a transfer member in the present invention. In addition, the cleaner 16 corresponds to the first exemplary embodiment of a cleaning unit in the present invention.

The full-color toner image on the intermediate image transfer belt 20 is transported to a region (a secondary transfer section T) in which the secondary transfer roll 22 is arranged as the intermediate image transfer belt 20 moves. In addition, a sheet is supplied to the secondary transfer section T from a sheet holding section 40 in synchronization with timing with which the full-color toner image is transported by the intermediate image transfer belt 20. Then, the full-color toner images are collectively and electrostatically transferred onto the transported sheet by a transfer electric field generated by the secondary transfer roll 22 in the secondary transfer section T.

Subsequently, the sheet, onto which the full-color toner image is electrostatically transferred, is separated from the intermediate image transfer belt 20 and is transported to the fixing unit 45. The full-color toner image on the sheet transported to the fixing unit 45 is fixed on the sheet by the fixing unit 45 by undergoing a fixing process using heat and pressure. Then, the sheet, on which the fixed image is formed, is transported to a sheet stacking member 41 provided in a discharge section 42 of the printer 1.

On the other hand, after the completion of the secondary transfer, toner (transfer residual toner) adhering to the intermediate image transfer belt 20 after the secondary transfer is removed by a belt cleaner 25 from the surface of the intermediate image transfer belt 20 for the next image formation cycle. In this manner, the printer 1 repeatedly performs image formation in cycles the number of which corresponds to the number of printed sheets.

Here, the cleaner 16 provided in each of the image forming units 11 will be further described.

Figure 2:
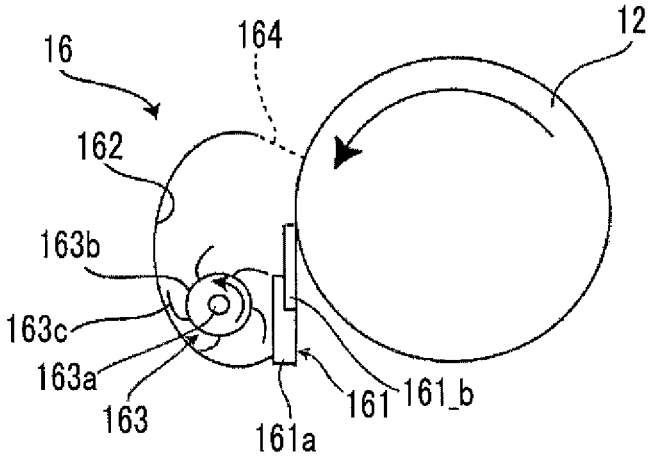
FIG. 2 is a side view conceptually illustrating a structure of a cleaner provided in each of image forming units.
Figure 3:
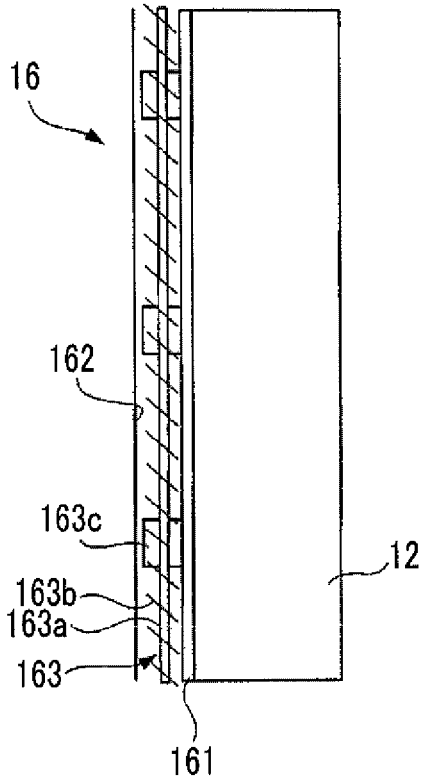
FIG. 3 is a top view conceptually illustrating the structure of the cleaner provided in each of the image forming units.

FIGS. 2 and 3 are conceptual configuration views conceptually illustrating the structure of the cleaner 16 provided in each of the image forming units 11, FIG. 2 is a side view (that is, a view of FIG. 1 as seen from the front side), and FIG. 3 is a top view (that is, a view of FIG. 1 as seen from above).

The cleaner 16 includes a cleaning blade 161 that contacts with the surface of the photoreceptor drum 12, a storage chamber 162 that stores toner or the like removed from the photoreceptor drum 12, an auger 163 that discharges the toner remaining in the storage chamber 162 to the outside of the cleaner 16, and a shield 164 that prevents powder such as toner from flowing to the outside of the cleaner 16.

The cleaning blade 161 corresponds to an example of a removing member in the present invention, and the storage chamber 162 corresponds to an example of a storage tank in the present invention.

The cleaning blade 161 is formed such that a planar member 161*b* made of rubber is attached to a metal plate 161*a*, and extends along the surface of the photoreceptor drum 12 in a vertical direction of FIG. 3. The planar member 161*b* of the cleaning blade 161 rubs the surface of the photoreceptor drum 12 as the photoreceptor drum 12 rotates, and thus, residual toner, an external additive, paper dust, and the like are scraped off the surface of the photoreceptor drum 12 to fall in the storage chamber 162. It is preferable that the planar member 161*b* is polyurethane.

The storage chamber 162 also extends along the surface of the photoreceptor drum 12 in the vertical direction of FIG. 3, and is connected to a collecting box which collects toner and the like at one end although not shown in the drawing.

The auger 163 has a structure in which a spiral blade 163*b* is attached around a rotation axis 163*a* extending along the surface of the photoreceptor drum 12 in the vertical direction of FIG. 3 and the rotation axis 163*a* is rotationally driven by driving force from a driving source (not shown) to discharge the toner and the like in the storage chamber 162 to the collecting box. The auger 163 corresponds to an example of a transport member in the present invention.

In addition, blade-shape elastic members 163*c* which protrude outward from the spiral blade 163*b* are attached in plural places in the middle of the rotation axis 163*a*. As the elastic members 163*c*, polyurethane or polyester may be used. Particularly, it is preferable that the elastic members 163*c* polyethylene terephthalate. The combination of the elastic members 163*c* and the rotation axis 163*a* with sections to which the elastic members 163*c* are attached corresponds to an example of a supply member in the present invention, and as described below, the elastic members 163*c* supply some of the toner in the storage chamber 162 to the surface of the photoreceptor drum 12.

The elastic members 163*c* have a length reaching the cleaning blade 161 and rotate integrally with the auger 163. When the elastic members 163*c* rotate, the leading end contacts with the cleaning blade 161 and thus, the elastic members 163*c* are elastically bent. Then, when the elastic members 163*c* further rotate, the leading end is separated from the cleaning blade 161, and the bending of the elastic members 163*c* are released so that the elastic members 163*c* extend elastically. As a result, some of the toner in the storage chamber 162 is flicked by the elastic members 163*c* and adheres to the surface of the photoreceptor drum 12.

Although powder such as toner or the like dusts in the storage chamber 162 with the flicking by the elastic members 163*c* or discharging by the spiral blade 163*b*, the shield 164 prevents such powder from flowing to the outside of the cleaner 16 to contaminate the inside of the apparatus. The shield 164 is a sheet made of resin and contacts with the surface of the photoreceptor drum 12 lightly to close a gap between the storage chamber 162 and the photoreceptor drum 12.

The toner which is flicked by the elastic members 163*c* and adheres to the surface of the photoreceptor drum 12 reaches cleaning blade 161 again as the photoreceptor drum 12 rotates. The performance of scraping residual toner or the like by the cleaning blade 161 is stabilized when a certain amount of toner or an external additive is accumulated between the leading end of the planar member 161*b* made of rubber and the surface of the photoreceptor drum 12 to form a so-called toner dam, and scraping force is strong. Then, the toner supplied to the surface of the photoreceptor drum 12 by the flicking by the elastic members 163*c* prevents such toner dam from being run out and is useful to maintain the cleaning capability of the cleaner 16. That is, cleaning capability is high and also stabilized in the cleaner 16 having such elastic members 163*c* compared to a cleaner not having the elastic members 163*c*.

Here, the condition in which the toner dam is likely to be run out will be examined.

When images having a low image density continue as an object image for image formation, the residual toner on the photoreceptor drum 12 is reduced. However, the rotation of the photoreceptor drum 12 continues for a time as much as the number of image formation cycles regardless of the image density. As a result, there is a possibility that the residual toner or the external additive accumulated in the toner dam is gradually reduced and is run out at the end.

In addition, when the concentration of the toner accommodated in the developing unit 15 shown in FIG. 1 is low, the toner adhering to the background section of the image is reduced and the residual toner is also reduced. Also, in this case, there is a possibility that the residual toner or the external additive accumulated in the toner dam is gradually reduced and is run out at the end.

In this manner, when a low-density image is formed or when the concentration of the toner in the developing unit 15 is low, the toner dam is likely to be run out and thus, in the exemplary embodiment, the image density of each color component is calculated from the image data in the image processor 35 shown in FIG. 1 and the result is notified to the controller 30. The calculation of the image density corresponds to indirect detection of the image density of the toner image actually formed on the photoreceptor drum 12. Further, in the developing unit 15 shown in FIG. 1, a concentration sensor not shown in the drawing is provided, and the concentration of the toner in the developing unit 15 which is detected by the concentration sensor is also notified to the controller 30. The image processor 35 corresponds to an example of an image density detecting unit in the present invention, and the developing unit 15 in which the concentration sensor is provided corresponds to an example of a concentration detecting unit in the present invention. Alternatively, the controller 30 may be regarded as an example of the combination of the image density detecting unit and the concentration detecting unit.

The controller 30 controls the rotation axis 163*a* in FIGS. 2 and 3 to frequently rotate as the image density is lowered for each color and controls the rotation axis 163*a* in FIGS. 2 and 3 to frequently rotate as the concentration of the toner in the developing unit 15 is lowered for each color. By the control of the controller 30 in such a manner, when the toner dam is likely to be run out, an amount of toner supplied to the photoreceptor drum 12 by the elastic members 163*c* is increased. Thus, the toner dam is prevented from being run out and the cleaning capability of the cleaner 16 is maintained.

The description of the first exemplary embodiment of the cleaning unit and the image forming apparatus of the present invention has been completed and then, a second exemplary embodiment will be described.

The second exemplary embodiment is the same as the first exemplary embodiment except that the structure of the cleaner is different, and thus, in the following description, the description in which the cleaner is focused will be made and redundant description will be omitted.

Figure 4:
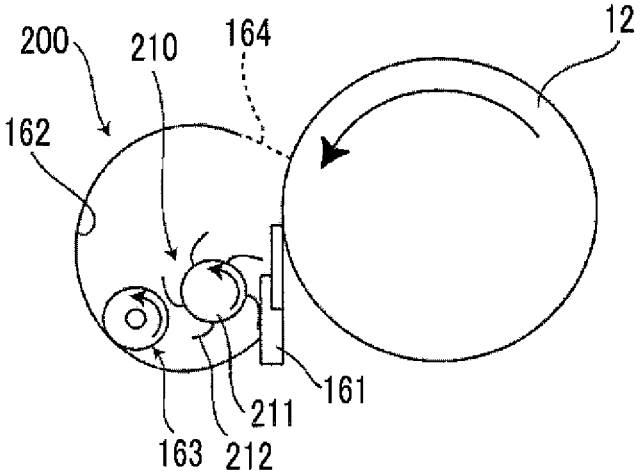
FIG. 4 is a side view conceptually illustrating a structure of a cleaner according to a second exemplary embodiment.
Figure 5:
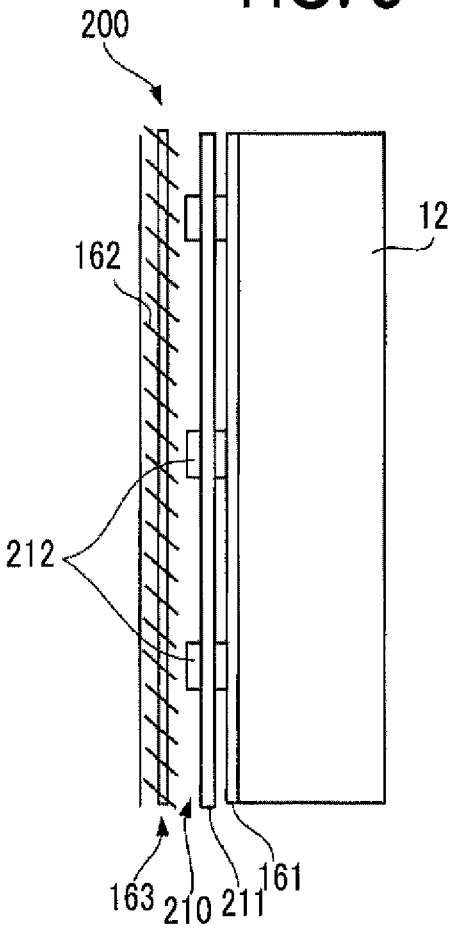
FIG. 5 is a top view conceptually illustrating the structure of the cleaner according to the second exemplary embodiment.

FIGS. 4 and 5 are conceptual configuration views conceptually illustrating a structure of a cleaner 200 according to the second exemplary embodiment, FIG. 4 is a side view (that is, a view of FIG. 1 as seen from the front side), and FIG. 5 is a top view (that is, a view of FIG. 1 as seen from above).

A cleaner 200 of the second exemplary embodiment includes the cleaning blade 161 that contacts with the surface of the photoreceptor drum 12, the storage chamber 162 that stores toner or the like removed from the photoreceptor drum 12, the auger 163 that discharges the toner remaining in the storage chamber 162 to the outside of the cleaner 200, and the shield 164 that prevents powder such as toner from flowing to the outside of the cleaner 200, as in the first exemplary embodiment.

Unlike the first exemplary embodiment, the cleaner 200 of the second exemplary embodiment includes a supply member 210 that supplies some of the toner in the storage chamber 162 to the surface of the photoreceptor drum 12 independently of the auger 163. The supply member 210 corresponds to an example of the supply member in the present invention. The supply member 210 in the second exemplary embodiment has a structure in which blade-shape elastic members 212 are attached in plural places of a rotation axis 211 which extends along the surface of the photoreceptor drum 12 in the vertical direction of FIG. 5, and is rotationally driven independently of the auger 163. Then, the leading end of the elastic members 212 contact with the cleaning blade 161 as the supply member 210 rotates, and the elastic members 212 are elastically bent. Then, when the elastic members 212 further rotate, the leading end is separated from the cleaning blade 161, and the elastic members 212 extend elastically. As a result, some of the toner in the storage chamber 162 is flicked by the elastic members 212 and adheres to the surface of the photoreceptor drum 12. Therefore, also in the second exemplary embodiment, the toner dam is prevented from being run out and the cleaning capability of the cleaner 200 is high and stabilized.

In addition, in the second exemplary embodiment, the driving of the rotation axis 211 of the supply member 210 is controlled by the controller 30 according to the image density of an object image for image formation or the concentration of the toner in the developing unit 15. That is, the controller 30 controls the supply member 210 to frequently rotate as the image density is lowered for each color and controls the supply member 210 to frequently rotate as the concentration of the toner in the developing unit 15 is lowered for each color. That is, also in the second exemplary embodiment, when the toner dam is likely to be run out, an amount of toner supplied to the photoreceptor drum 12 is increased. Thus, the toner dam is prevented from being run out and the cleaning capability of the cleaner 200 is maintained. Further, in the second exemplary embodiment, the rotation of the supply member 210 is independent of the rotation of the auger 163 and, for example, the auger 163 frequently rotates as the image density is increased so that toner clogging in the storage chamber 162 is prevented. In this manner, in the second exemplary embodiment, the supply member 210 and the auger 163 are controlled respectively at appropriate rotation timing.

Next, a third exemplary embodiment of the cleaning unit and the image forming apparatus of the present invention will be described. The third exemplary embodiment is also the same as the first exemplary embodiment except that the structure of the cleaner is different and thus, in the following description, the description in which the cleaner is focused will be made and redundant description will be omitted.

Figure 6:
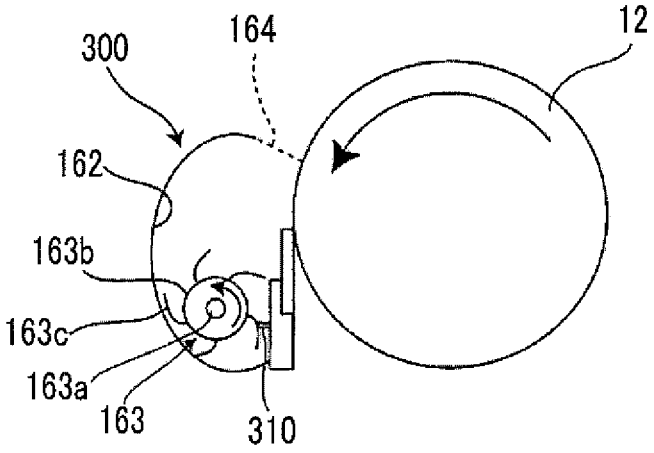
FIG. 6 is a side view conceptually illustrating a structure of a cleaner according to a third exemplary embodiment.
Figure 7:
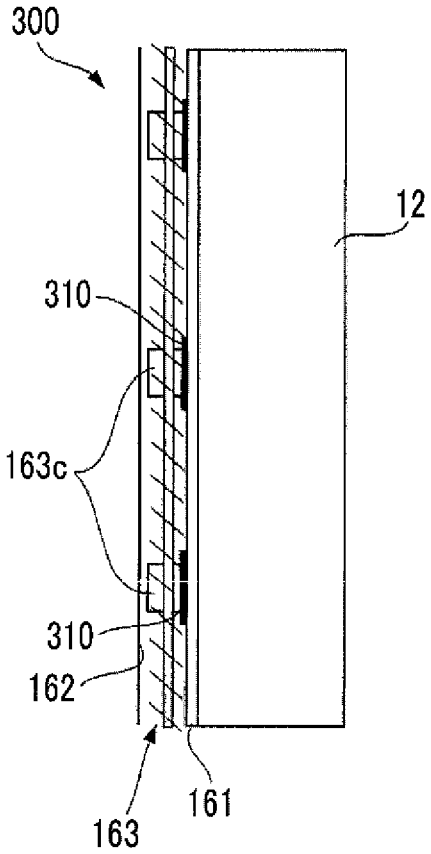
FIG. 7 is a top view conceptually illustrating the structure of the cleaner according to the third exemplary embodiment.

FIGS. 6 and 7 are conceptual configuration views conceptually illustrating a structure of a cleaner 300 according to the third exemplary embodiment, FIG. 6 is a side view (that is, a view of FIG. 1 as seen from the front side), and FIG. 7 is a top view (that is, a view of FIG. 1 as seen from above).

A cleaner 300 of the third exemplary embodiment also includes the cleaning blade 161 that contacts with the surface of the photoreceptor drum 12, the storage chamber 162 that stores toner or the like removed from the photoreceptor drum 12, the auger 163 that discharges the toner remaining in the storage chamber 162 to the outside of the cleaner 300, and the shield 164 that prevents powder such as toner from flowing to the outside of the cleaner 300, as in the first exemplary embodiment.

In addition, as in the first exemplary embodiment, the auger 163 has a structure in which the spiral blade 163*b* is attached around the rotation axis 163*a* and the blade-shape elastic members 163*c* are attached in plural places in the middle of the rotation axis 163*a*.

Unlike the first exemplary embodiment, the cleaner 300 of the third exemplary embodiment includes protrusions 310 in plural places of the cleaning blade 161. When the blade-shape elastic members 163*c* rotate as the auger 163 rotates, the leading end of the elastic members 163*c* are caught on the protrusion 310, and the elastic members 163*c* are largely bent in an elastic manner. Further, the leading end is separated from the protrusion 310 by the rotation of the elastic members 163*c*, and the elastic members 163*c* elastically extends. As a result, some of the toner in the storage chamber 162 is more strongly flicked by the elastic members 163*c* than in the first exemplary embodiment and adheres to the surface of the photoreceptor drum 12.

Since more toner is supplied to the surface of the photoreceptor drum 12 than in the first exemplary embodiment by more strongly flicking the toner in the cleaner 300 of the third exemplary embodiment than in the first exemplary embodiment, the cleaning capability of the cleaner 300 becomes higher and more stabilized.

Finally, a toner particle diameter in which the toner is efficiently supplied to the surface of the photoreceptor drum 12 will be examined.

Figure 8:
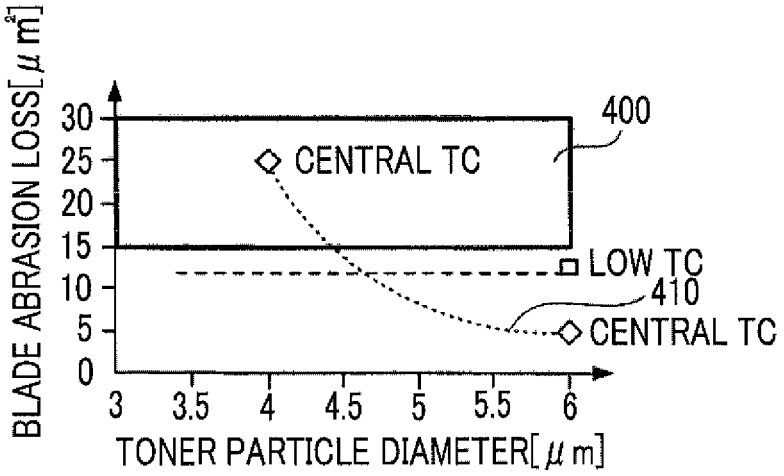
FIG. 8 is a graph illustrating a relationship between a toner particle diameter and a blade abrasion loss.

FIG. 8 is a graph illustrating a relationship between a toner particle diameter and blade abrasion loss.

The horizontal axis in FIG. 8 indicates a volume average particle diameter of the toner particles and the vertical axis indicates blade abrasion loss. In addition, the graph in FIG. 8 shows a result when image formation is repeated until a total rotation number of the photoreceptor drum excluding the elastic members from the cleaner of the above-described first exemplary embodiment reaches 5200.

It has been known that the blade abrasion loss has a strong correlation with the toner dam and the cleaning capability of the cleaner, and when the blade abrasion loss is high, the toner dam is run out and the cleaning capability of the cleaner is lowered. A region 400 where the blade abrasion loss reaches 15 $\mu m^2$ or more is a red zone, and the cleaning capability of the cleaner is not sufficient. Thus, image quality deterioration appears apparently in the formed image.

As described above, when the concentration of the toner in the developing unit is low, the residual toner is reduced and the toner dam is likely to be run out. When the volume average particle diameter of the toner is 6.0 μm, the blade abrasion loss reaches nearly 15 $\mu m^2$, provided that the concentration of the toner in the developing unit is low. The relationship between the volume average particle diameter of the toner and blade abrasion loss when the concentration of the toner in the developing unit is a normal concentration is indicated by a graph curve 410. When the volume average particle diameter of the toner is 4.0 μm, the blade abrasion loss reaches the red zone 400 even in the normal concentration. Thus, it is preferable that the toner supply as in each of the above-described exemplary embodiments is effective. As seen the graph curve 410, it is understood that, the blade abrasion loss in the central concentration of the toner in the developing unit when the volume average particle diameter of the toner reaches 4.5 μm or smaller is larger than the blade abrasion loss when the volume average particle diameter of the toner is 6.0 μm and the concentration of the toner in the developing unit is low. That is, when the volume average particle diameter of the toner is 4.5 μm or smaller, it may be said that the toner supply as in each of the above-described exemplary embodiments is effective. Further, it is preferable that the lower limit of the volume average particle diameter of the toner be 2.0 μm or larger from the viewpoint of manufacturability.

The description of each of the above-described exemplary embodiments has been completed.

In the above description, an example of the supply member in the present invention which is the blade-shape elastic member has been shown, but the supply member in the present invention may be an inelastic member which supplies toner by slowly drawing the toner up with a blade.

In addition, in the above description, an example in which image density is indirectly detected based on image data has been shown as the image density detecting unit in the present invention, but the image density detecting unit in the present invention may directly detect the image density of a toner image using an optical sensor or the like.

Further, in the above description, as an example of the exemplary embodiment of the image forming apparatus, a so-called tandem type color machine including plural image holding members has been shown, but the image forming apparatus of the present invention may be a so-called revolver type color machine which forms plural toner images of plural colors on one image holding member, or may be a single color machine.

Further, in the above description, as an example of the image forming apparatus, a printer has been shown, but the image forming apparatus of the present invention may be a facsimile, a copier, or a multifunctional machine.

Further, in the above description, as an example of the image forming apparatus, an indirect-transfer type image forming apparatus using an intermediate image transfer belt has been shown, but the image forming apparatus of the present invention may be a direct-transfer type image forming apparatus in which a toner image is directly transferred to a sheet from an image forming section.

In addition, in the above description, as an example of the image forming device in the present invention, an electrophotographic apparatus has been shown, but the image forming device in the present invention may be an electrode array type apparatus which allows each toner particle to fly separately toward an image holding member using the electrode array.

Further, in the above description, as an example of the transfer unit in the present invention, a contact type charging roll has been shown, but the transfer unit in the present invention may be a non-contact type such as scorotron, corotron, or the like.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning unit comprising:

a removing member that contacts with a surface of a cleaning target and removes adherent matters on the surface of the cleaning target;

a storage section that stores the adherent matters removed by the removing member;

a supply member that has a blade and rotates the blade in the storage section to supply some of the adherent matters stored in the storage section to the surface of the cleaning target, wherein the blade of the supply member is made of an elastic material; and a protrusion that protrudes in the storage section to flick the adherent matters as the blade of the supply member is temporarily caught with rotation of the blade and to release catching of the blade with further rotation of the blade.

2. The cleaning unit according to claim 1, further comprising:

a transport member that is provided in the storage section and rotates to transport the adherent matters stored in the storage section to the outside of the storage section, wherein the supply member rotates with being integral with the transport member.

3. The cleaning unit according to claim 1, further comprising:

a transport member that is provided in the storage section and rotates to transport the adherent matters stored in the storage section to the outside of the storage section, wherein the supply member rotates with being independent of the transport member.

4. An image forming apparatus comprising:

an image holding member that has a surface on which a toner image is formed to hold the toner image;

an image forming device that forms a toner image on the surface of the image holding member;

a transfer unit that transfers the toner image to a transfer member from the surface of the image holding member; and a cleaning unit that removes toner remaining on the surface of the image holding member after the toner image is transferred by the transfer unit to clean the surface of the image holding member, wherein a volume average particle diameter of the toner is 2.0 μm to 4.5 μm, and wherein the cleaning unit includes a removing member that contacts with the surface of the image holding member and rubs the surface to remove the toner from the surface, a storage section that stores the toner removed by the removing member, and a supply member that has a blade and rotates the blade in the storage section to supply some of the toner stored in the storage section to the surface of the image holding member.

5. The image forming apparatus according to claim 4, further comprising:

an image density detecting unit that detects density of the toner image formed by the image forming device, wherein the supply member supplies more toner as the density of the toner image detected by the image density detecting unit is lowered.

6. The image forming apparatus according to claim 5, further comprising:

a protrusion that protrudes in the storage section to flick the toner stored in the storage section as the blade of the supply member is temporarily caught with rotation of the blade and to release catching of the blade with further rotation of the blade.

7. The image forming apparatus according to claim 4, wherein the image forming device stores the toner therein to form a toner image on the surface of the image holding member using the toner, and has a concentration detecting unit that detects concentration of the toner in the image forming device, and the supply member supplies more toner as the concentration of the toner detected by the concentration detecting unit is lowered.

8. The image forming apparatus according to claim 4, wherein the blade of the supply member is made of an elastic material.

9. The image forming apparatus according to claim 4, further comprising:

a transport member that is provided in the storage section and rotates to transport the toner stored in the storage section to the outside of the storage section, wherein the supply member rotates with being integral with the transport member.

10. The image forming apparatus according to claim 4, further comprising:

a transport member that is provided in the storage section and rotates to transport the toner stored in the storage section to the outside of the storage section, wherein the supply member rotates with being independent of the transport member.

* * * * *